US008132777B2

(12) United States Patent
Delbridge et al.

(10) Patent No.: US 8,132,777 B2
(45) Date of Patent: Mar. 13, 2012

(54) BLOWOUT PREVENTER HAVING MODIFIED HYDRAULIC OPERATOR

(75) Inventors: Scott Delbridge, Edmonton (CA); Dean Foote, Edmonton (CA)

(73) Assignee: Alberta Petroleum Industries Ltd., Edmonton, Alberta (CA)

( * ) Notice: Subject to any disclaimer, the term of this patent is extended or adjusted under 35 U.S.C. 154(b) by 1086 days.

(21) Appl. No.: 12/018,657

(22) Filed: Jan. 23, 2008

(65) Prior Publication Data

US 2009/0183880 A1 Jul. 23, 2009

(51) Int. Cl.
*E21B 33/06* (2006.01)

(52) U.S. Cl. ..... 251/1.3; 251/62; 166/319

(58) Field of Classification Search ..... 251/1.1, 251/1.2, 1.3, 62; 166/85.4, 319
See application file for complete search history.

(56) References Cited

U.S. PATENT DOCUMENTS

| | | | | | |
|---|---|---|---|---|---|
| 2,912,214 | A | * | 11/1959 | Allen et al. | 251/1.3 |
| 3,208,357 | A | * | 9/1965 | Allen et al. | 251/1.3 |
| 3,554,480 | A | * | 1/1971 | Rowe | 251/1.3 |
| 3,918,478 | A | * | 11/1975 | Le Rouax | 251/1.3 |
| 4,437,643 | A | * | 3/1984 | Brakhage et al. | 251/1.3 |
| 4,456,215 | A | * | 6/1984 | Bishop et al. | 251/1.2 |
| 4,492,359 | A | * | 1/1985 | Baugh | 251/1.3 |
| 5,123,493 | A | | 6/1992 | Wenzel | |
| 5,647,446 | A | | 7/1997 | Wenzel | |
| 5,653,418 | A | * | 8/1997 | Olson | 251/1.3 |
| 7,798,466 | B2 | * | 9/2010 | Springett et al. | 251/1.3 |

FOREIGN PATENT DOCUMENTS

CA 2506828 C * 7/2009

* cited by examiner

*Primary Examiner* — John Fristoe, Jr.
*Assistant Examiner* — Andrew J Rost
(74) *Attorney, Agent, or Firm* — Millen, White, Zelano & Branigan PC

(57) ABSTRACT

A blowout preventer for use in the oil and gas industry having a single modified, dual-acting hydraulic operator per door, comprising a reconfigured adapter. The reconfigured adapter comprises a body having a longitudinal bore, a plurality of hydraulic fluid passageways therethrough, and is slidably received by the blowout preventer.

6 Claims, 16 Drawing Sheets

BLOWOUT PREVENTER HAVING MODIFIED HYDRAULIC OPERATOR

FIELD OF THE INVENTION

The present invention relates to blowout preventers used in the oil and gas industry. More specifically, the present invention relates to hydraulically operated blowout preventers.

BACKGROUND OF THE INVENTION

Blowout preventers (BOPs) are large valves that encase wellbore piping at ground surface. One form of BOP is a ram-type BOP, which typically comprises two horizontally opposed "ram" assemblies having ram blocks that sealingly engage with each other at the center of the wellbore, or around a tubular element in the wellbore, to prevent fluid flow therethrough.

Over time, the ram blocks must be replaced due to wear and tear, or to change their size to accommodate varying sizes of pipe. Accordingly, ram-type BOPs require means for accessing the ram blocks without having to remove the entire BOP from the wellhead. Ram access doors or "bonnets", connected to the ram assemblies are provided. These doors, which are capable of opening to allow servicing or replacement of the ram blocks, are commonly provided on each side of the BOP. Due to the size and weight of the doors, hydraulic operators are commonly used to control opening and closing of the doors, thereby easing access to the ram blocks.

It is known in the industry to mount the access doors on a hinge pin such that the doors swing between an open and a closed position. Commonly, hinged-door BOPs are configured so that hydraulic fluid passageways extend through a bore drilled through the hinge pin, or through a hinge bracket. However, due to the intricacy of the fluid passageways, perfect alignment between the pin or bracket and the door must occur or leakage may result. The requirement for extremely precise and accurate positioning of various parts makes the hinged-door BOP prone to early failure and difficult to repair and/or maintain.

In order to address these difficulties with hinged doors, they have been mounted upon shafts or "slide studs" extending outwardly from the body of the BOP. For instance, the Type "U" Blowout Preventer manufactured by Cameron Iron Works, Inc. (Houston, Tex. U.S.A.), provides doors which are hydraulically manoeuvred along shafts towards and away from the BOP. In order to operate door movement, the Cameron BOP system has two separate and distinct hydraulic operators per door; one for opening the doors and one for closing the doors. The need for two hydraulic cylinders per door adds considerable weight, size and complexity to the overall configuration of the BOP.

Ram-type BOPs comprising a single, dual-acting (i.e. capable of opening and closing) hydraulic operator for each door are also known. For instance, Canadian Patent No. 2,506,828, filed 29 Apr. 2005 (the '828 application) by Dean Foote and Scott Delbridge, describes such a ram-type BOP. The assembly disclosed in the '828 application, however, is known to be somewhat difficult to assemble and prone to damage, thereby resulting in costs due to the requirement for providing exacting tolerances on some components.

Having reference to prior art FIGS. 1 to 5, one such component is the adapter "A" which forms part of the hydraulic operator. The adapter A, as configured in the '828 patent, involves certain features which are problematic, more particularly:

- the adapter "A" forms hydraulic fluid channels "F" and is threadably engaged with the piston sleeve "PS" component of the hydraulic operator "O". This engagement requires that the adapter "A" be significant in length to accommodate threading interface "T" (see FIGS. 2 and 3), and may result in damage to O-ring-type seals "S" around the adapter during installation;
- second, the adapter "A" must be secured in place within the hydraulic operator "O" by a plurality of cap screws "C". Each cap screw "C", sealed by its own O-ring, presents a potential "leakage point" of hydraulic fluid from the adapter to the exterior of the BOP; and
- third, a number of O-ring-type seals "OS" around the adapter "A" and the cap screws "C" are unreliable and are subject to wear and tear requiring constant maintenance and upkeep.

Accordingly, the complexity of the prior art adapter arrangement disclosed in the '828 application causes maintenance to be challenging and costly, and results in a significant number of "leakage points" for system failure (due to leakage of hydraulic fluid).

There is therefore a need in the industry for a ram-type BOP comprising a single, dual-acting hydraulic operator for each door that is lighter, more compact and not susceptible to system failure as a result of fluid leakage.

SUMMARY OF THE INVENTION

A blowout preventer (BOP), having modified hydraulic operators, is described. The ram-type BOP disclosed herein is known and comprises a single, dual-acting, telescoping hydraulic operator for controlling the opening and closing of each door assembly. The operator has been modified to provide a reconfigured adapter for increased reliability and ease of manufacturing.

The reconfigured adapter generally comprises a body having a longitudinal bore and forming a plurality of hydraulic fluid passageways therethrough. The adapter is slidably received within the door assembly of the BOP and abutted in position by the operator, which is threadably secured to the door assembly. A threaded engagement between the operator and the door assembly may result in a more stable and secure anchor point from which the operator may telescope. Further, the threaded connection may result in the reduction of pressure boundaries and may provide means for obtaining a self-contained hydraulic pressure system.

It is an object of the present invention to provide an adapter that is slidably received and retained by the door assembly of the BOP, thereby eliminating the need for a threaded engagement between the adapter and the BOP.

It is a further object of the present invention to provide a modified adapter that is slidably received and retained by the door assembly of the BOP and abutted into position by the hydraulic operator, thereby eliminating the need for cap screws and their associated o-ring seals and providing a solid anchor point that is internal to the hydraulic pressure system.

DESCRIPTION OF THE EMBODIMENTS

By way of background, a ram-type blowout preventer (BOP) having a single, dual-acting hydraulic operator will now be described with reference to FIGS. 6-16.

Ram-Type Blowout Preventer

Figure 6:
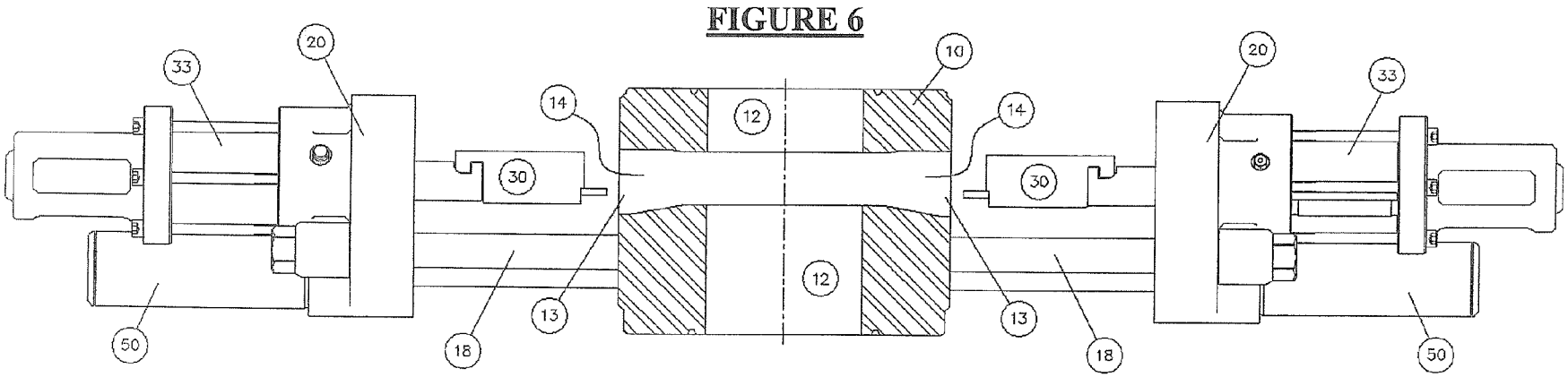
FIG. 6 is a side view of a BOP, as described herein, having a body and two door assemblies, showing a cross-section of the BOP body to expose the horizontal and vertical passageways therewithin.
Figure 7:
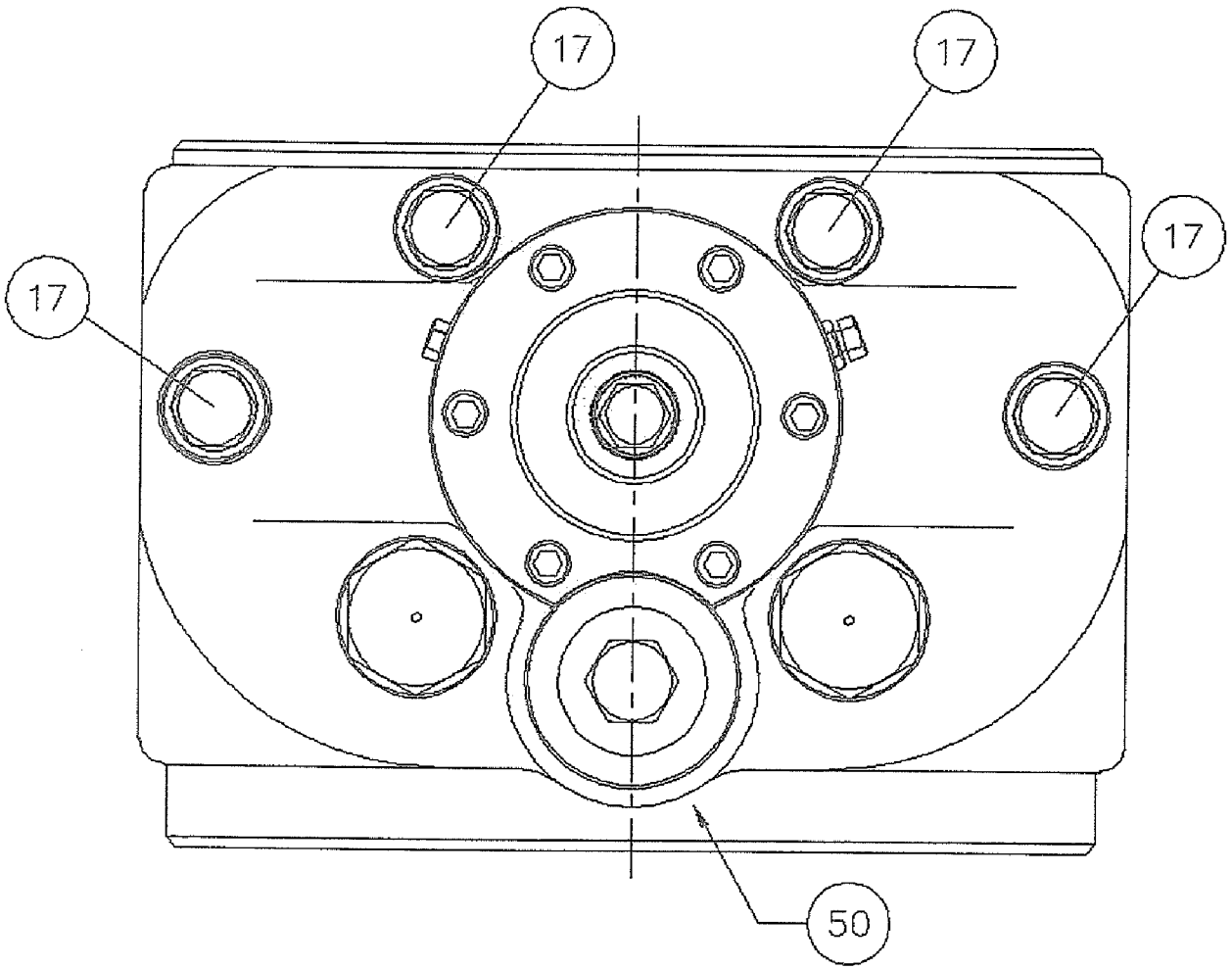
FIG. 7 is an end view of the BOP shown in FIG. 6.

The body of the BOP 10 forms two longitudinal and intersecting passageways (as seen in FIG. 6). A first vertical passageway 12 is aligned with the wellbore and forms a conduit for piping and fluid flow from the wellbore. A second, horizontal passageway, intersects vertical passageway 12, to form two bilaterally opposed ram receiving passages 14, each having an opening 13 at the terminal or distal end.

A pair of closures, or door assemblies 20, for "sealing or "closing" opening 13, are positioned adjacent to the distal ends of the ram receiving passage 14. Each door assembly 20 is slidably mounted upon a pair of slide studs 18, protruding from and integral to the BOP body 10. In order to "lock" the door assemblies in sealing engagement with the BOP body 10, and thereby prevent blowouts of the wellbore, movement of door assemblies 20 along slide studs 18 is prevented. For instance, stud nuts 17 may be threaded along the slide studs 18 to lock the door assemblies 20 in place (see FIGS. 7 and 8). In order to "unlock" the doors, the stud nuts 17 may be disengaged (see FIGS. 10 and 11).

For ease of reference, the term "proximal(ly)" herein refers to elements positioned closer, or towards, the BOP body 10, and the term "distal(ly)" shall refer to elements farther away from the BOP body 10.

Figure 8:
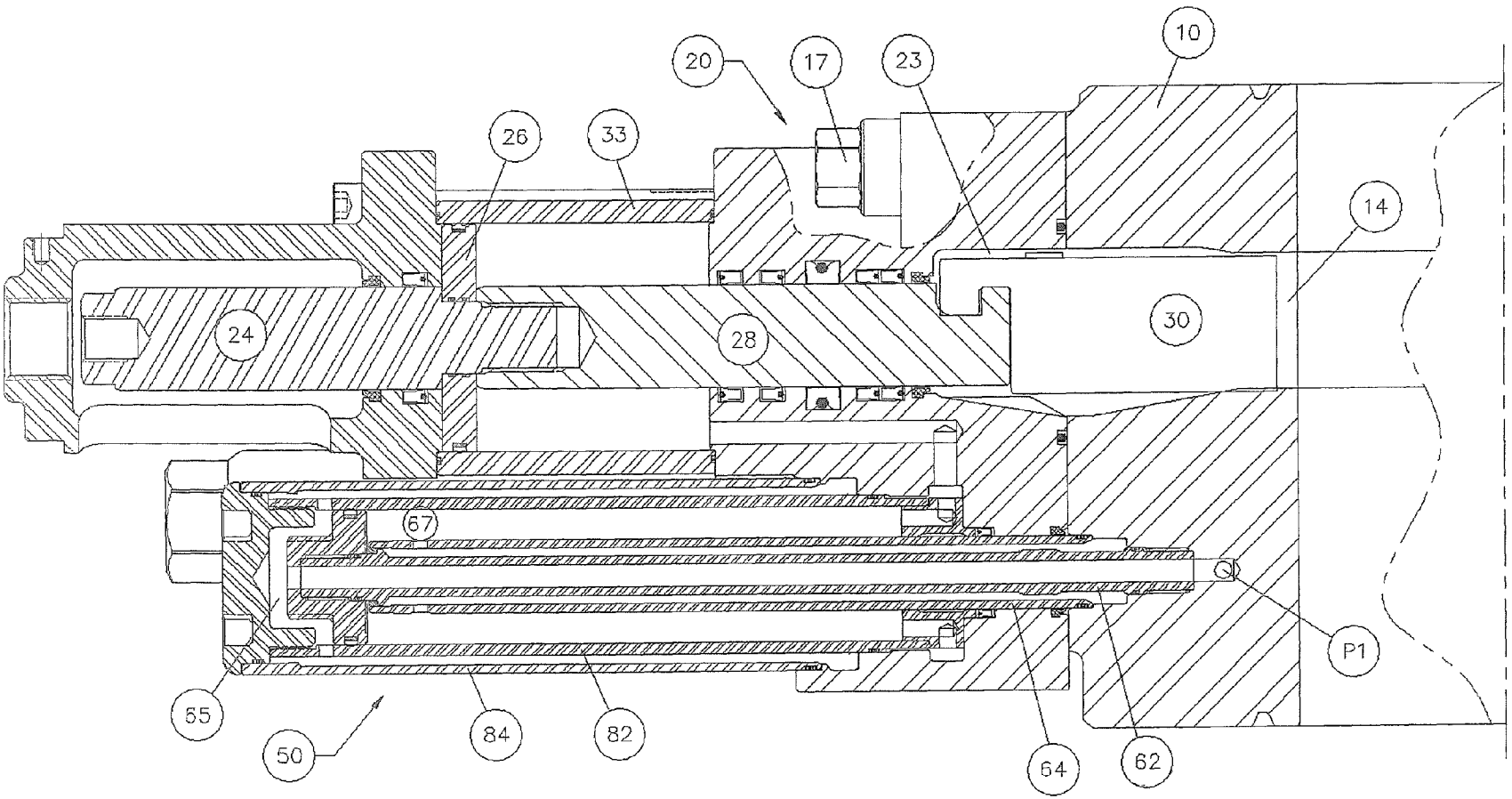
FIG. 8 is a longitudinal cross-sectional view of one door assembly and operator of the BOP, shown in FIG. 6, with the door assembly closed and locked against the BOP body and the ram assembly in the "open" position.

Having regard to FIG. 8, each door assembly 20 comprises an interior longitudinally extending bore, referred to as the ram passageway 23, and a hydraulic fluid cylinder 33, which is aligned with and distal to the ram passageway 23. The following elements are associated with the ram passageway 23 and hydraulic cylinder 33 of the door assembly 20 and form one reciprocating unit:

- a hydraulic piston 26, positioned within the hydraulic cylinder 33, wherein the hydraulic piston 26 and the hydraulic cylinder 33 form:
  - a first fluid ram chamber 25 (see FIG. 9), distally adjacent to the piston 26; and
  - a second fluid ram chamber 27 (see FIG. 9), proximally adjacent to the piston 26;
- a piston shaft 24, reciprocally actuated within the hydraulic cylinder 33 by the hydraulic piston 26;
- a ram shaft 28, connected with the piston shaft 24 and positioned within the ram passageway 23. Reciprocal movement of the piston 26 biases the ram shaft 28 inwardly and the piston shaft 24 outwardly from the BOP body 10; and
- a ram block 30, releasably secured to the ram shaft 28 at its proximal end.

When door assemblies 20 are closed against BOP body 10, the opening 13 formed by the BOP body 10 is aligned with the ram passageway 23 and the hydraulic cylinder 33. Movement of the piston 26 (see arrows 55 in FIG. 9), within hydraulic cylinder 33, results in the simultaneous movement of piston shaft 24, ram shaft 28 and ram block 30. For ease of reference, the assembly comprising piston shaft 24, piston 26, ram shaft 28 and ram block 30 shall hereinafter be referred to as the ram assembly 40. It should be understood that the ram assembly 40 need not comprise three distinct elements as herein described, but may be configured from one or any number of separate components or parts. When the BOP is engaged, each opposed ram assembly 40 extends inwardly through opening 13 into ram receiving passageway 14 until the two assemblies meet within vertical passageway 12, thereby closing the wellbore and blocking fluid flow therethrough.

Hydraulic Operators

By way of further background, one single (or double-acting), telescoping hydraulic operator 50 may actuate each of:

- longitudinal reciprocation of the ram assemblies 40 between an open and closed position; and,
- longitudinal movement of the door assemblies 20 along slide studs 18, thereby opening and/or closing the BOP.

Figure 11:
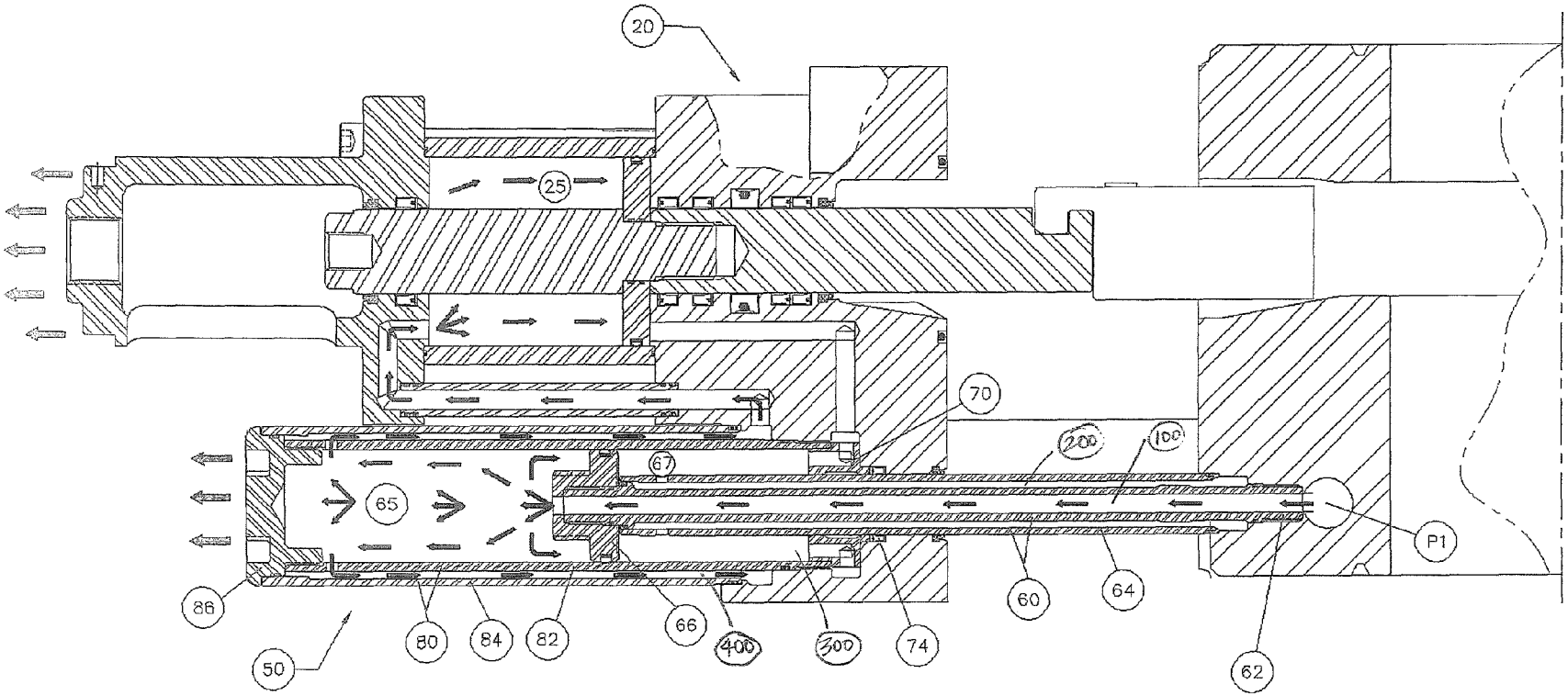
FIG. 11 is a longitudinal cross-sectional view of the door assembly and operator, as shown in FIG. 10, as they continue to telescope away from the BOP body, having arrows within the operator and the door assembly depicting hydraulic fluid flow therethrough.
Figure 12:
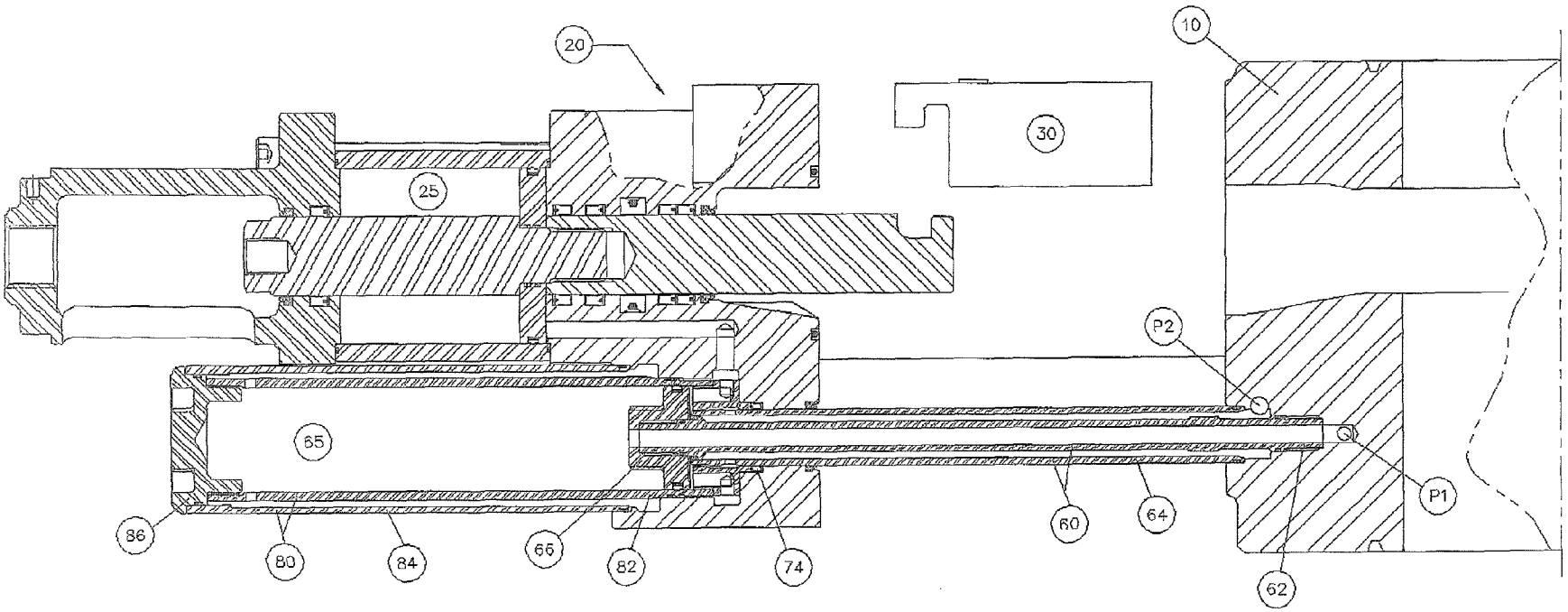
FIG. 12 is a longitudinal cross-sectional view of the door assembly and operator, shown in FIGS. 10 and 11, with the door assembly and the operator fully telescoped to the open position, and the ram block being removed.
Figure 13:
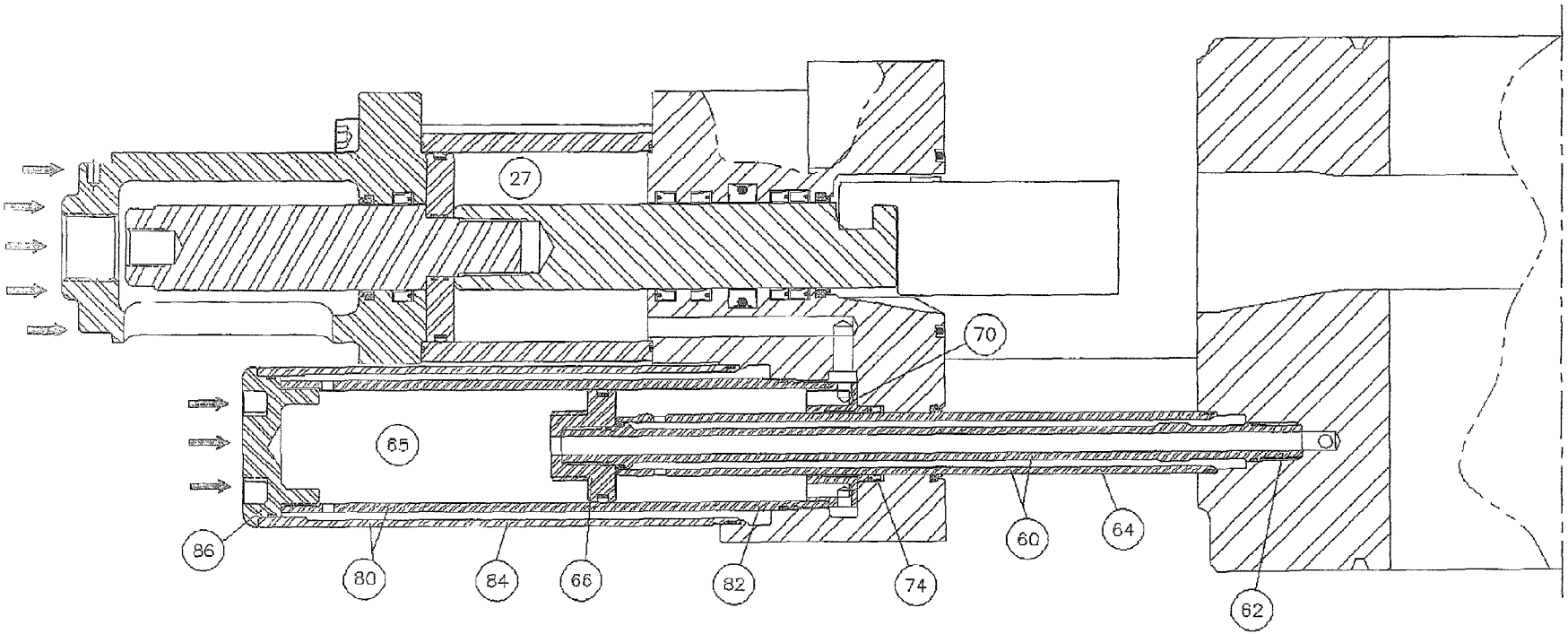
FIG. 13 is a longitudinal cross-sectional view of the door assembly and operator showing the door assembly and the operator retracting towards the closed position against the BOP body (see directional arrows).
Figure 14:
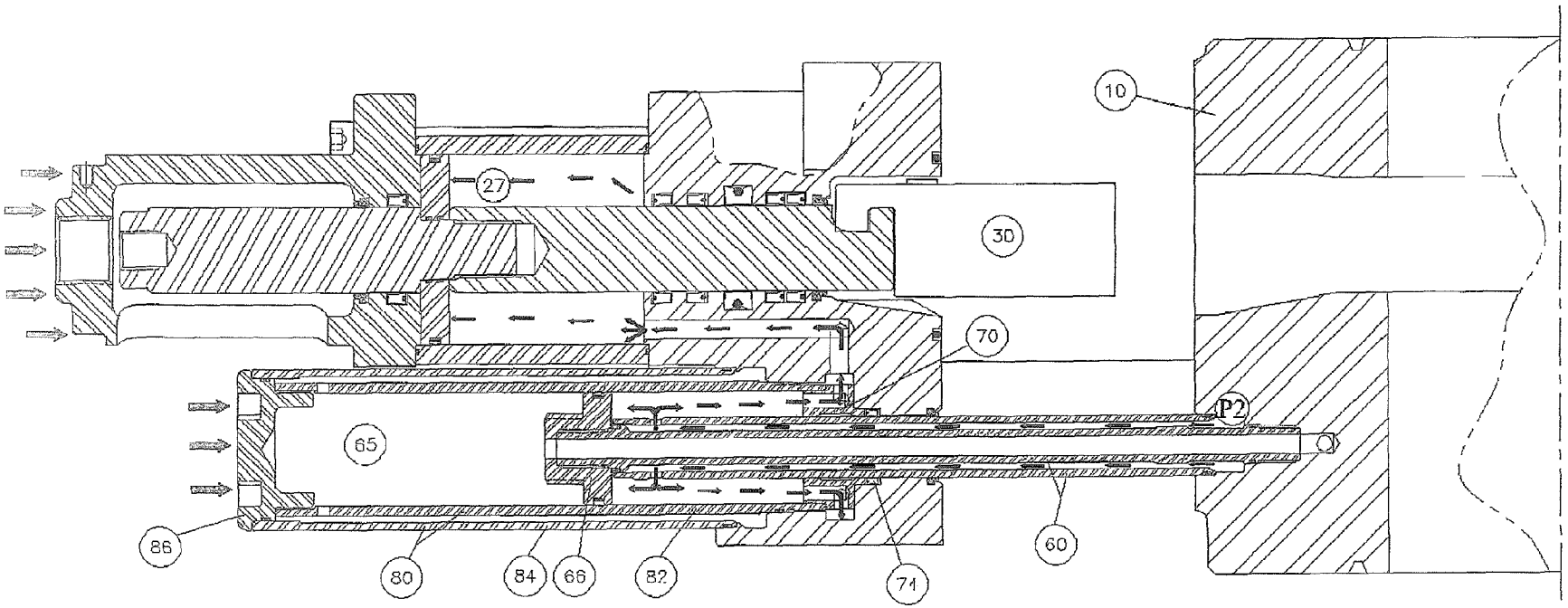
FIG. 14 is a longitudinal cross-sectional view of the door assembly and operator as they telescopically retract towards the body of the BOP having arrows depicting hydraulic fluid flow therethrough.
Figure 15:
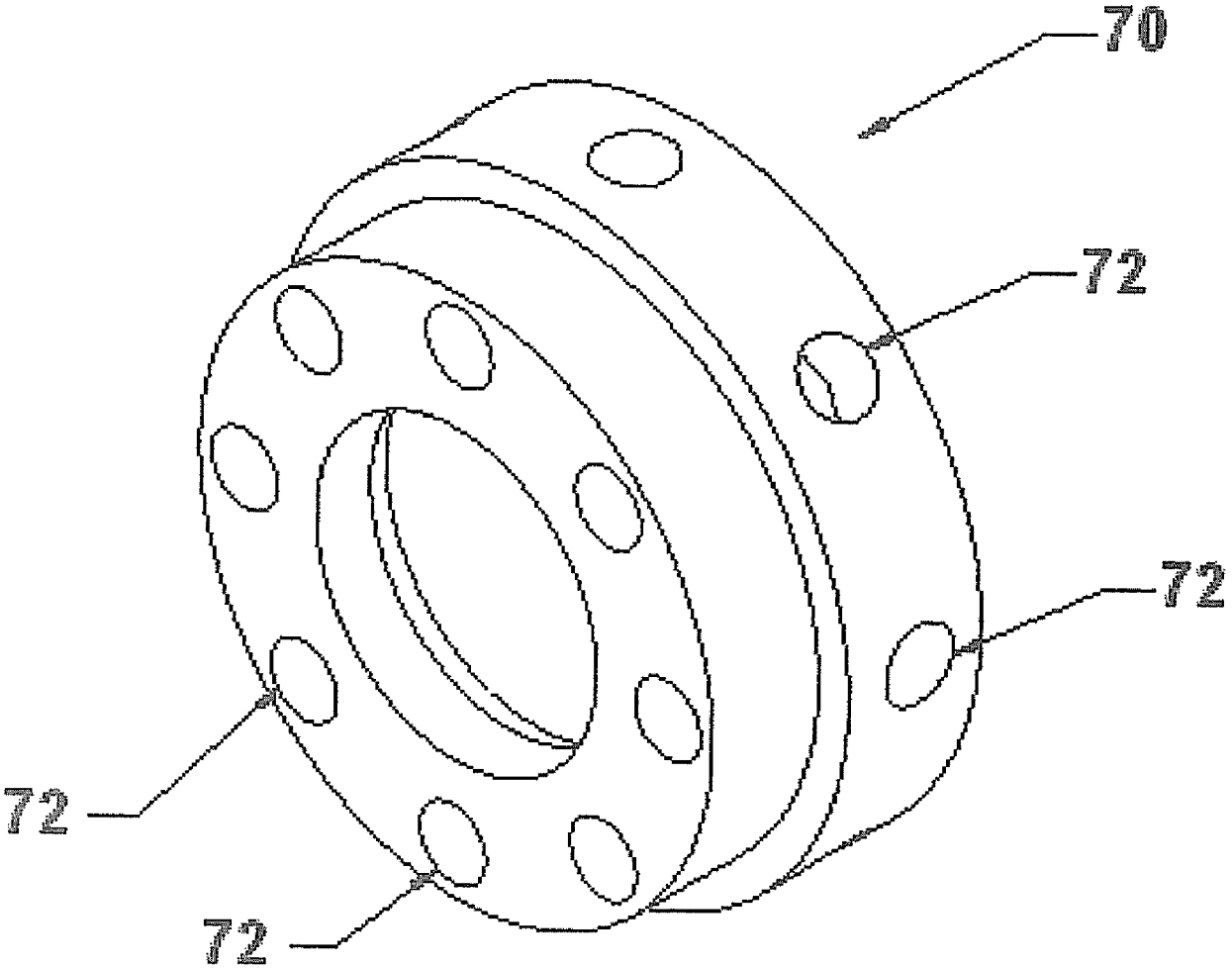
FIG. 15 is a side elevational view of the adapter as described herein.
Figure 16:
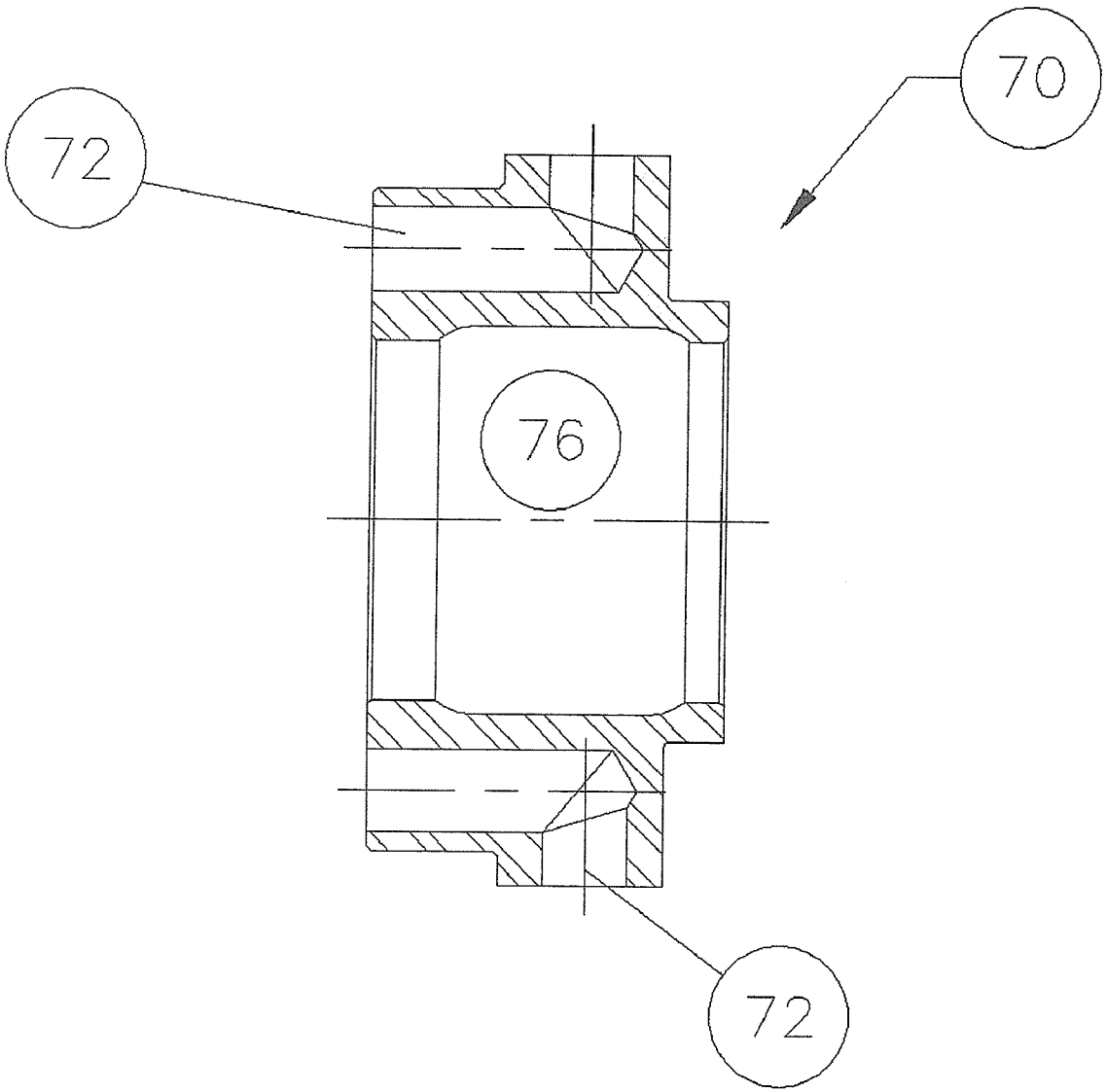
FIG. 16 is a sectional side view of the adapter shown in FIG. 15.

Having regard to FIGS. 11 and 12, a telescoping hydraulic operator 50, comprising a system of interconnected cylindrical tubes is provided. The hydraulic operator 50 comprises:

- a first dual-cylinder assembly 60 (see FIG. 12) having a proximal first end, associated with the BOP body 10, and a distal second end, and dual-cylinder assembly 60 comprises:
  - a body anchor tube 62, forming a first fluid passageway 100, sealingly connected at its first end to the BOP body 10 and aligned to receive hydraulic fluid from the fluid inlet P1 (see FIG. 11); and
  - a piston sleeve 64, slidably inserted over the second end of the body anchor tube 62, which forms a second fluid passageway 200 therebetween, having its first end sealably engaged with the BOP body 10 and aligned to receive hydraulic fluid from the fluid inlet P2 (see FIG. 14);

wherein the piston sleeve 64 is retained in position against the BOP body 10 by an operator piston 66, which abuts the second end of the piston sleeve 64 and is threadably engaged with the second end of the body anchor tube 62. It should be understood that the connection between the operator piston 66 and the first dual-cylinder assembly may be an equivalent form of sealable connection.

The first dual-cylinder assembly 60 is telescopically connected with:

a second dual-cylinder assembly 80 having a first proximal end, associated with the door assembly 20, and a second distal end, comprising:

a piston cylinder 82, having its first proximal end recessed within and threadably engaged to door assembly 20, thereby providing positive retention for the operator 50 or an anchor point from which the operator may telescope;

a cylinder housing 84, slidably inserted over the second end of the piston cylinder 82, which forms a third fluid passageway 300 therebetween that is continuous with first the fluid passageway 100, the cylinder housing 84 being engaged, at its first end, with the door assembly 20;

a cylinder retainer 86, for adjoining piston cylinder 82 and cylinder housing 84, so that the cylinder retainer 86 abuts the second end of the cylinder housing 84 and retains the cylinder housing 84 in position against the door assembly 20, the retainer 86 being threadably engaged with piston cylinder 82; and wherein the first dual-cylinder assembly 60 is telescopically connected, through an adapter 70 (see FIGS. 13 and 14) slidably recessed within door assembly 20, to the second dual-cylinder assembly 80.

Telescopic hydraulic operator 50 further comprises two fluid receiving chambers formed within piston cylinder 82. More particularly, a first operator fluid chamber 65 is distally adjacent to operator piston 66, and a second operator fluid chamber 67 is proximally adjacent to operator piston 66. Second chamber 67 forms a fourth fluid passageway 400 that is continuous with the second fluid passageway 200.

Having regard to FIGS. 11 and 14, directional arrows depict the hydraulic fluid flow as the door assembly is opened (FIG. 11) and closed (FIG. 14). Fluid flow is described in more detail below.

The Adapter

An adapter 70 is used to provide a hydraulic fluid interface between fluid flowing through operator 50 and door assembly 20. It further serves as a flow resistor within the operator 50.

The adapter 70 is slidably recessed within door assembly 20. The first proximal end of the piston cylinder 82, which is sealingly or threadably engaged with door assembly 20, abuts adapter 70, thereby retaining adapter 70 in place. Fluid passageways 72 formed in adapter 70 provide fluid communication conduits between fluid chamber 67 and fourth fluid passageway 400 in the operator 50 and fluid ram chamber 27 in door assembly 20. A seal 74 for retaining hydraulic fluid within the adapter 70 is positioned between the adapter 70 and the door assembly 20. The seal 74 preferably comprises a seal designed for reciprocal movement. For example a PolyPak™ seal (Parker Seals, Utah, U.S.A.) may be used to prevent fluid leakage from within the operator 50 to the exterior of door assembly 20.

Figure 1:
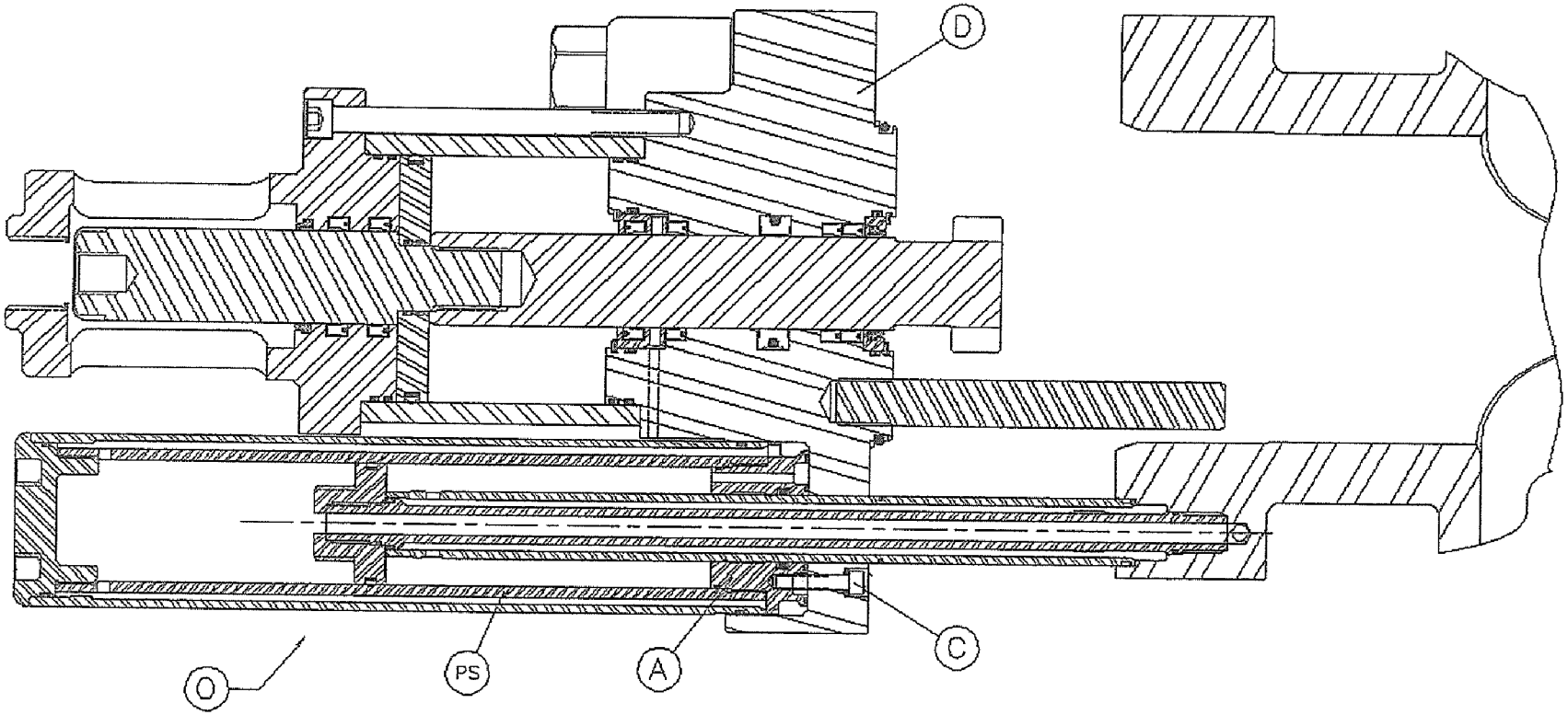
FIGURE 1 (PRIOR ART)
FIG. 1 (prior art) is a longitudinal cross section of a door assembly forming part of a ram-type BOP having an adapter threadably engaged to the piston sleeve of a hydraulic operator.
Figure 2:
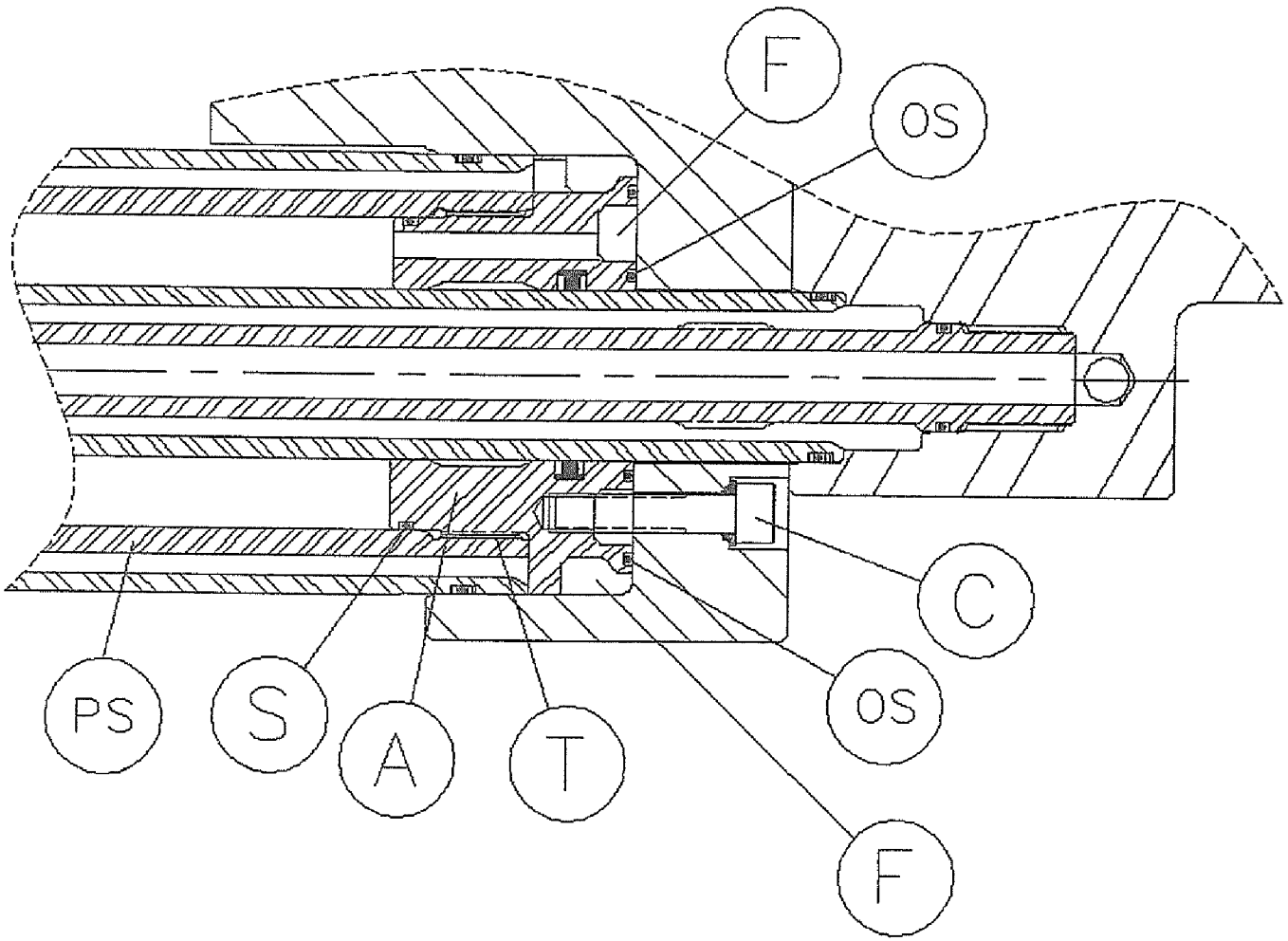
FIGURE 2 (PRIOR ART)
FIG. 2 (prior art) is an amplified cross sectional view of the adapter of FIG. 1 threadably engaged with the operator's piston sleeve.
Figure 3:
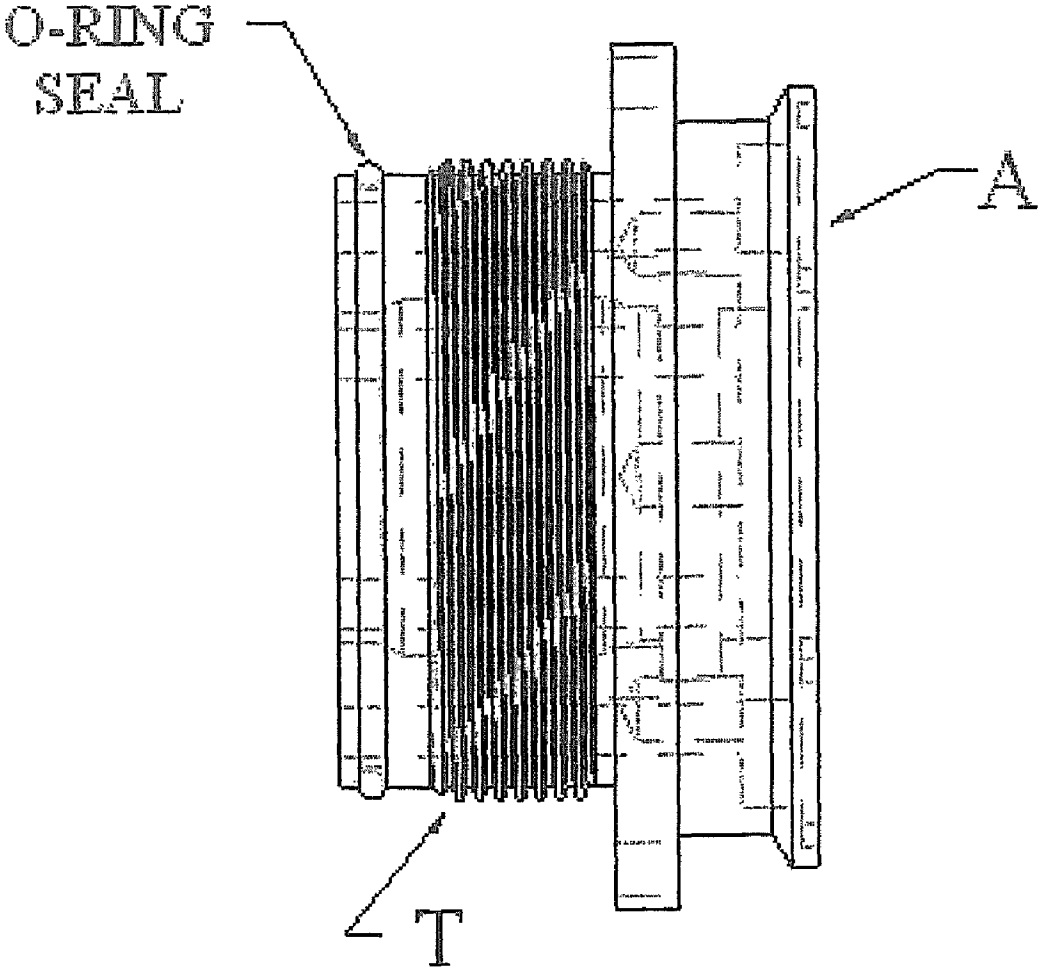
FIGURE 3 (PRIOR ART)
FIG. 3 (prior art) is an elevational side view of the adapter of FIG. 1.
Figure 4:
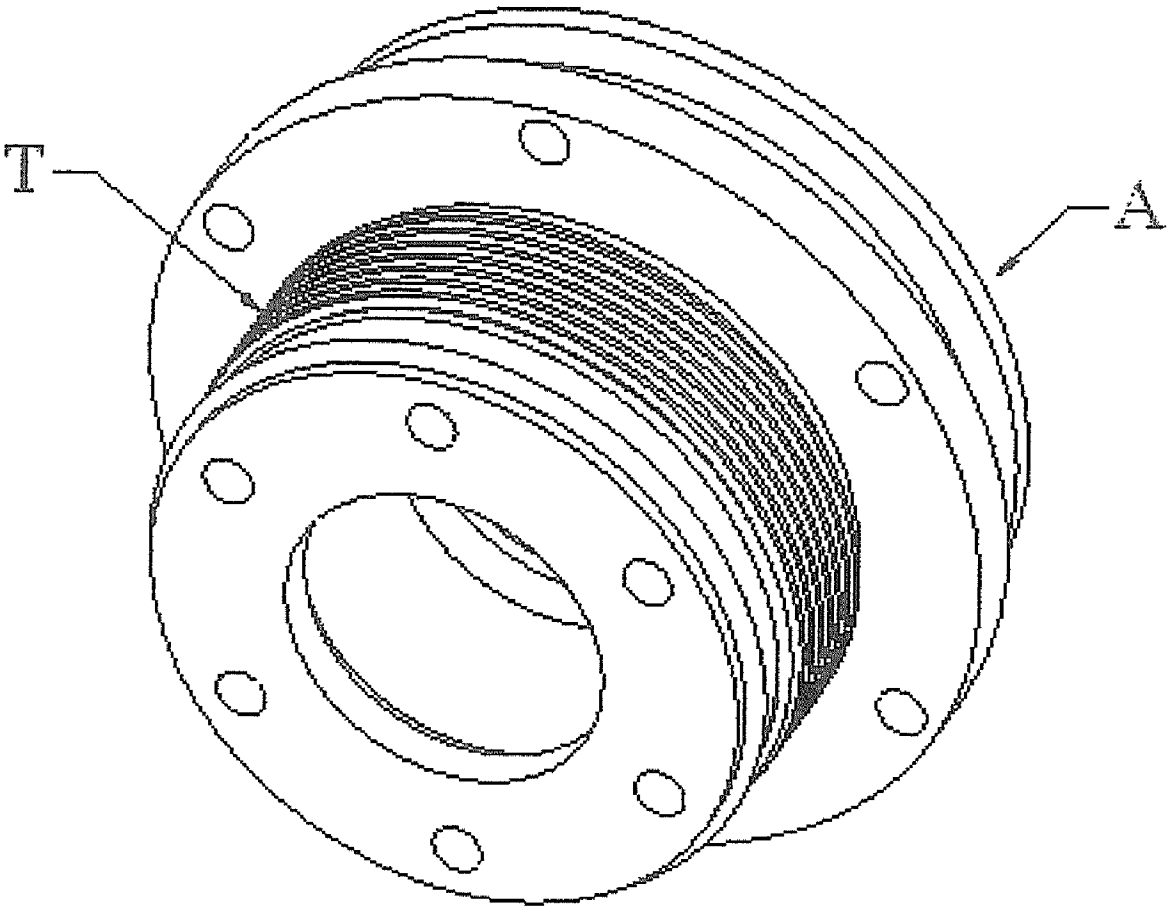
FIGURE 4 (PRIOR ART)
FIG. 4 (prior art) is a perspective view of the adapter of FIG. 1.
Figure 5:
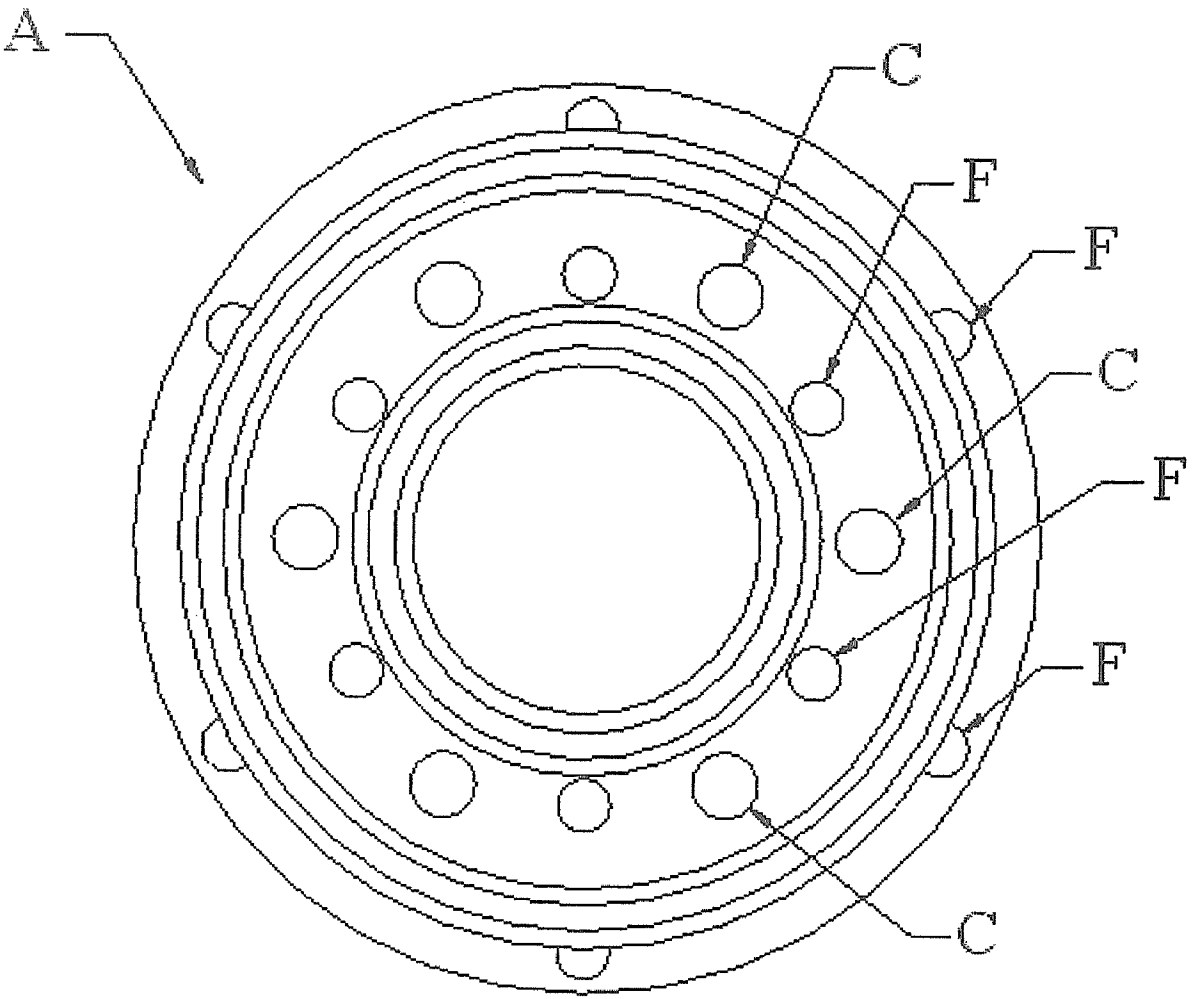
FIGURE 5 (PRIOR ART)
FIG. 5 (prior art) is a top plan view of the adapter of FIG. 1.

The adapter 70 is configured shorter in length than the known adapter A shown in prior art FIG. 1 as the need for a threading interface T is eliminated. The adapter 70 is configured without cap-screw receiving ports, as the need to secure it in place with cap screws and their associated low-reliability O-ring seals is eliminated.

Operation

Figure 9:
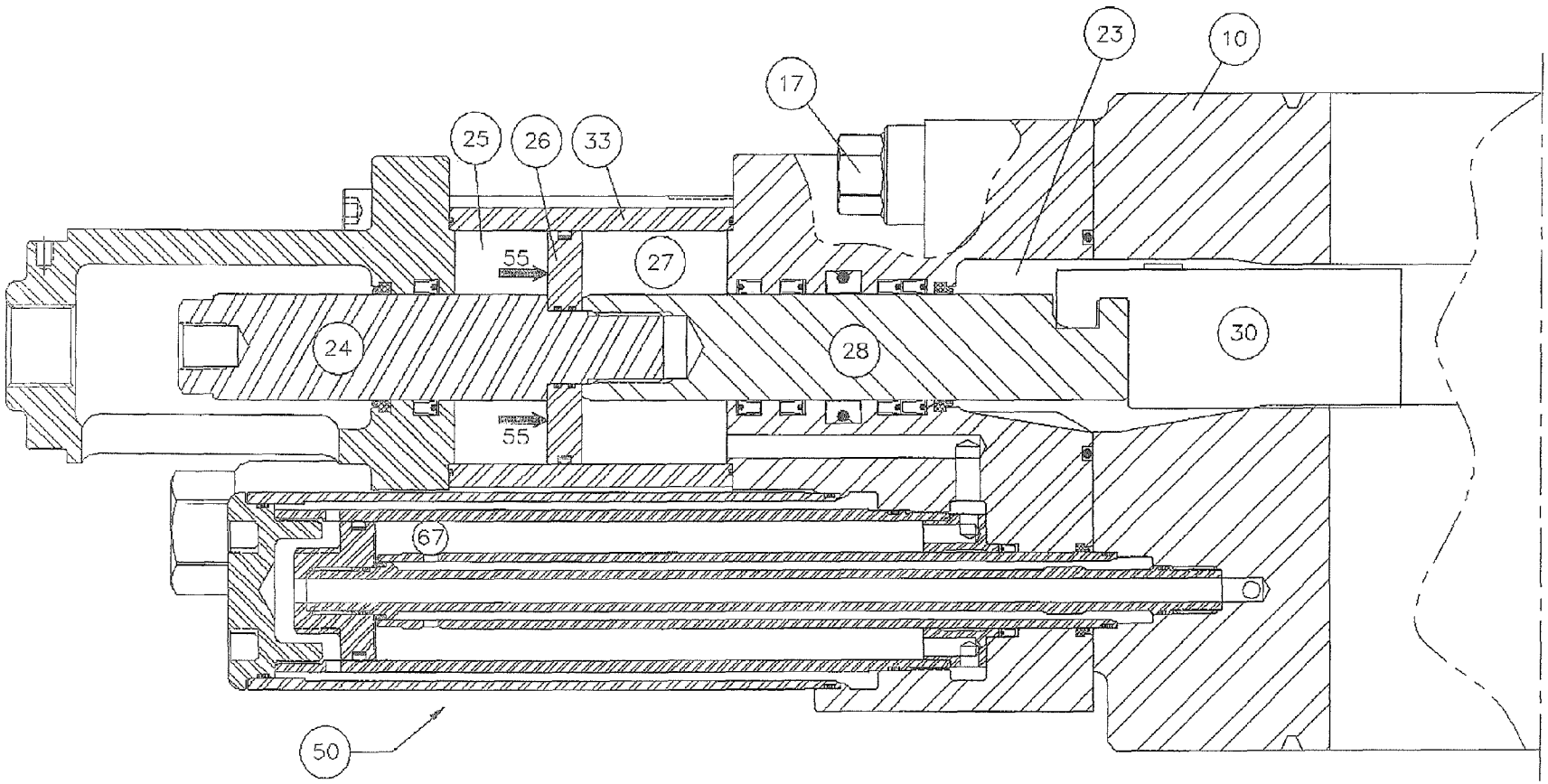
FIG. 9 is a longitudinal cross-sectional of the door assembly and operator shown in FIG. 8 with movement, as shown by directional arrows, of the ram assembly towards a closed position.
Figure 10:
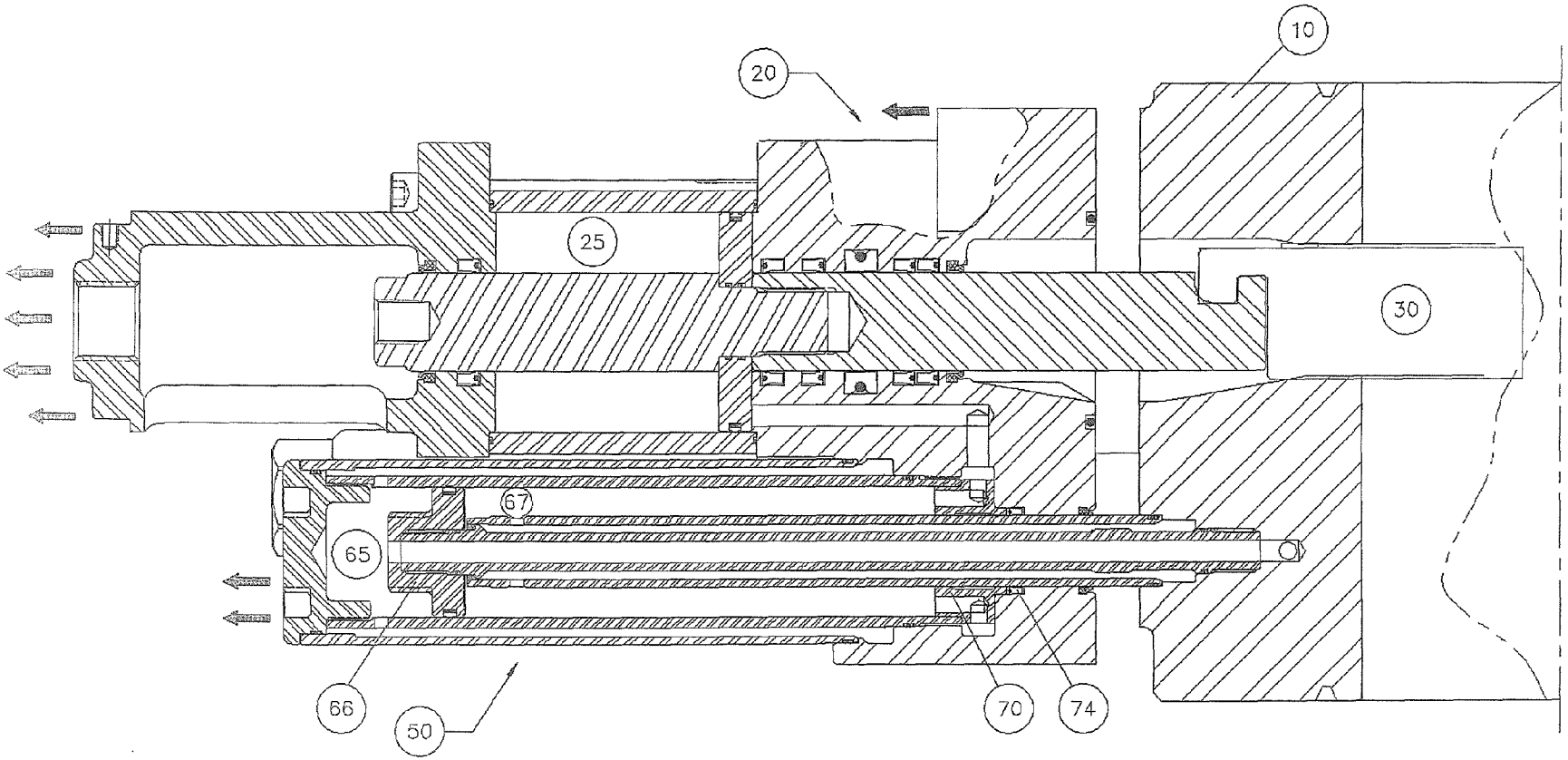
FIG. 10 is a longitudinal cross-sectional view of the door assembly and operator with the door assembly unlocked and the operator telescoping away from the BOP body (see directional arrows).

Opening and Closing Ram Blocks 30 (Doors Locked):

Having regard to FIGS. 8 and 9, when stud nuts 17 are engaged and door assemblies 20 are "locked" to the BOP body, fluid may be introduced through inlet port P1 to bias the ram assembly 40 into a "closed" position (arrows 55). Hydraulic fluid introduced through inlet port P1 flows along the interior passageway 100 of the body anchor 62 and the operator piston 66 into distal operator fluid chamber 65 (see fluid arrows in FIG. 11). As pressure in fluid chamber 65 increases, fluid will flow along the fluid passageway 300 formed between piston cylinder 82 and cylinder housing 84 into distal ram chamber 25 (see fluid arrows in FIG. 11). As fluid pressure increases in ram chamber 25, ram assembly 40 is biased inwardly towards BOP body 10. The opposed ram assemblies 40 travel along ram passageway 23 into ram receiving passageways 14 and sealingly engage each other within the wellbore, thereby "closing" the BOP and preventing blowouts.

To open the ram blocks 30, the flow of hydraulic fluid may be reversed by introducing the fluid into inlet port P2. Fluid will flow along the passageway 200 formed between body anchor cylinder 62 and piston sleeve 64 into proximal operator fluid chamber 67 and fourth fluid passageway 400 (see FIG. 14). Fluid leaves the fluid chamber 67 of the operator 50 through adapter 70 and enters proximal fluid ram chamber 27. This causes outward longitudinal movement of piston 26 and the entire ram assembly 40 (arrow 57). As ram assembly 40 moves outwardly, ram blocks 30 are disengaged and drawn back through ram receiving passageways 14 into door assemblies 20, thereby "opening" the BOP.

Door Assemblies 20

When stud nuts 17 are disengaged from BOP body 10, the door assemblies 20 may be opened and closed, thereby allowing access to the ram blocks 30 (see FIGS. 10-13).

Opening Door Assemblies 20

In order to open door assemblies 20, hydraulic fluid may be introduced into fluid inlet port P1 and into distal ram chamber 25 (see FIG. 11). As fluid pressure increases in chamber 25, ram assembly 40 is biased inwardly towards BOP body 10. As the ram assembly 40 travels inwardly, fluid pressure in chamber 65 increases, resulting in operator 50 telescoping away from BOP body 10 along slide studs 18. As a result, the entire door assembly 20 progresses outwardly along slide studs 18 (see FIG. 10). As the second dual-cylinder assembly 80 becomes fully extended, the ram assembly 40 is simultaneously extended inwardly toward BOP body, thereby moving the ram blocks 30 into the gap formed between the door assembly 20 and BOP body 10.

Closing Door Assemblies 20

To close the door assemblies 20, hydraulic fluid may be introduced into inlet port P2, whereby it flows into proximal operator fluid chamber 67 (see FIG. 14). As pressure in chamber 67 increases, the second dual-cylinder assembly 80 and the entire door assembly 20 travel inwardly toward the BOP body 10, until the door assembly 20 engages the BOP body 10. Stud nuts 17 may then be threadably engaged with the BOP body 10.

Once door assembly 20 is secured in place, ram assembly 40 may closed as described above.

From the foregoing description, one skilled in the art can easily ascertain the essential characteristics of this invention and, without departing from the spirit and scope thereof, can make various changes and modifications of the invention to adapt it to various usages and conditions.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein are incorporated by reference herein.

The embodiments of the invention in which an exclusive Property or Privilege is claimed are defined as follows:

1. A blowout preventer, comprising:

a) a body forming intersecting horizontal and vertical passageways extending through the body forming first and second inlet ports for introducing hydraulic fluid to the body, the body having slide studs extending outwardly therefrom;

b) a pair of door assemblies, slidably mounted on the slide studs and capable of being releasably secured to the body, each door assembly having a longitudinal bore extending therethrough and further comprising:

a ram block, and means for actuating reciprocal movement of the ram block;

c) a telescoping hydraulic operator having a first dual-cylinder assembly telescopically connected with a second dual-cylinder assembly, wherein:

i. the first dual-cylinder assembly forms first and second hydraulic fluid passageways and has:

a first end received by body, wherein the first fluid passageway communicates with the first fluid inlet port of the body, and the second fluid passageway communicates with the second fluid inlet port of the body, and a second end engaged with an operator piston, and ii. the second dual-cylinder assembly forms third and fourth hydraulic fluid passageways and has:

a first end threadably engaged with the door assembly, wherein third fluid passageway communicates with first fluid passageway and the fourth fluid passageway communicates with the second fluid passageway, and a second end connected to a cylinder retainer;

d) an adapter, slidably received by the door assembly, abutted with and secured in place by the second dual-cylinder assembly, the adapter forming:

i. a plurality of hydraulic fluid channels communicated with the fourth fluid passageway, and ii. a longitudinal bore for receiving the first dual-cylinder assembly; and e) sealing means for reducing leakage from the fourth passageway;

wherein fluid flow through the first fluid passageway into the third fluid passageway actuates longitudinal travel of the operator and the door assembly away from body, and longitudinal travel of the actuating means towards the body; and wherein fluid flow through the second fluid passageway into the fourth fluid passageway actuates longitudinal travel of the operator and the door assembly towards the body, and longitudinal travel of the actuating means away from body.

2. The blowout preventer in claim 1, wherein the door assemblies are secured to the body by stud nuts.

3. The blowout preventer in claim 2, wherein the sealing means comprises a seal configured for reciprocal movement.

4. A blowout preventer, comprising:

a) a body forming intersecting horizontal and vertical passageways extending through the body forming first and second inlet ports for introducing hydraulic fluid to the body, the body having slide studs extending outwardly therefrom;

b) a pair of door assemblies, slidably mounted on the slide studs and capable of being releasably secured to the body, each door assembly having a longitudinal bore extending therethrough and further comprising:

a piston shaft, a ram shaft, connected to the piston shaft, a ram block, releasably secured to the ram shaft, a hydraulically controlled piston, in connection with the piston shaft, for actuating reciprocal movement of the ram block;

c) a telescoping hydraulic operator having a first dual-cylinder assembly telescopically connected with a second dual-cylinder assembly, wherein:

i. the first dual-cylinder assembly forms first and second hydraulic fluid passageways and has:

a first end received by body, wherein the first fluid passageway communicates with the first fluid inlet port of the body, and the second fluid passageway communicates with the second fluid inlet port of the body, and a second end engaged with an operator piston, and ii. the second dual-cylinder assembly forms third and fourth hydraulic fluid passageways and has:

a first end threadably engaged with the door assembly, wherein third fluid passageway communicates with first fluid passageway and the fourth fluid passageway communicates with the second fluid passageway, and a second end connected to a cylinder retainer;

d) an adapter, slidably received by the door assembly, abutted with and secured in place by the second dual-cylinder assembly, the adapter forming:

i. a plurality of hydraulic fluid channels communicated with the fourth fluid passageway, and iii. a longitudinal bore for receiving the first dual-cylinder assembly; and e) sealing means for reducing leakage from the fourth passageway;

wherein fluid flow through the first fluid passageway into the third fluid passageway actuates longitudinal travel of the operator and the door assembly away from body, and longitudinal travel of the piston towards the body; and wherein fluid flow through the second fluid passageway into the fourth fluid passageway actuates longitudinal travel of the operator and the door assembly towards the body, and longitudinal travel of the piston away from the body.

5. The blowout preventer in claim 4, wherein the door assemblies are secured to the body by stud nuts.

6. The blowout preventer in claim 5, wherein the sealing means comprises a seal configured for reciprocal movement.

* * * * *